US008337281B2

(12) United States Patent
Levsen

(10) Patent No.: US 8,337,281 B2
(45) Date of Patent: Dec. 25, 2012

(54) SELF-ALIGNING ROTARY BLADE HOLDER FOR SHARPENER

(75) Inventor: Clark A. Levsen, Shawnee, KS (US)

(73) Assignee: Hantover, Inc., Overland Park, KS (US)

( * ) Notice: Subject to any disclaimer, the term of this patent is extended or adjusted under 35 U.S.C. 154(b) by 853 days.

(21) Appl. No.: 12/488,393

(22) Filed: Jun. 19, 2009

(65) Prior Publication Data

US 2010/0323591 A1 Dec. 23, 2010

(51) Int. Cl.
*B24B 7/04* (2006.01)
*B24B 9/04* (2006.01)

(52) U.S. Cl. ..... 451/285; 451/45; 451/293; 451/349; 451/379

(58) Field of Classification Search ..... 76/85; 451/45, 451/193, 246, 285, 293, 349, 374, 379, 398
See application file for complete search history.

(56) References Cited

U.S. PATENT DOCUMENTS 4,198,750 A * 4/1980 Bettcher ..... 30/276
5,667,427 A 9/1997 Airhart et al.
7,896,729 B2 * 3/2011 Levsen ..... 451/193
2009/0075570 A1 3/2009 Levsen
2011/0237166 A1 * 9/2011 Chang ..... 451/279
2012/0024125 A1 * 2/2012 Walker et al. ..... 83/402

OTHER PUBLICATIONS

Exhibit A—photographs of prior art rotary blade sharpener and single rotary blade holder (photographs taken Apr. 20, 2007).
Exhibit B—photographs of prior art multiple blade holders (photographs taken Apr. 20, 2007).
Printout from Bettcher Website (printed Aug. 2, 2007).

* cited by examiner

*Primary Examiner* — Timothy V Eley
(74) *Attorney, Agent, or Firm* — Hovey Williams LLP

(57) ABSTRACT

A universal blade sharpening machine is operable to securely hold and sharpen any one of multiple variously sized circular blades. The machine includes a blade-sharpening drive with an adjustable blade sharpener and also includes a universal blade holder that is rotatably powered by the drive. The blade holder includes a blade-receiving chassis that holds the blade during sharpening and is rotatable about a rotation axis of the blade holder. The chassis includes a plurality of radially spaced blade-retaining sections each associated with a respective one of the circular blades.

33 Claims, 9 Drawing Sheets

SELF-ALIGNING ROTARY BLADE HOLDER FOR SHARPENER

BACKGROUND

1. Field

The present invention relates generally to blade sharpening devices. More specifically, embodiments of the present invention concern a blade sharpening machine that accommodates various sizes of endless rotary blades.

2. Discussion of Prior Art

Powered rotary knives that have a rotating annular blade are used in the meat processing industry for dressing an animal carcass. The process of dressing the carcass normally involves the removal of meat and fat from bones as well as removal of fat from meat. Rotary knives enable workers to perform this process with much greater efficiency than with traditional, unpowered knives because the annular blade is spun at very high rotational speeds. Blades dull during use and must be sharpened periodically. Powered blade sharpeners for sharpening annular blades are also known in the art. Powered blade sharpeners are used to sharpen annular blades during the blade manufacturing process and to sharpen used blades that have a dull edge.

However, prior art rotary blade sharpeners are problematic and suffer from certain limitations. For example, prior art sharpeners require multiple blade holders for accommodating a range of blade sizes. Blade holders in the prior art are also problematic in that installation and removal of blades is slow and inefficient.

Furthermore, prior art holders also tend to promote uneven sharpening along the blade edge. For example, prior art holders permit the blade to be installed in a position offset from the rotational axis of the sharpener. In addition, prior art holders often deform or warp the held blade. Off-axis positioning and blade deformation result in uneven sharpening of the blade edge, which can further reduce the life of the blade and increase the cost of providing blades for a rotary knife. These problems are further aggravated by the severity of blade wear that is common in the industry. In order to avoid production down-time, processors must keep a large supply of blades on hand as well as invest significant capital in purchasing and maintaining numerous blade holders and powered sharpeners.

Accordingly, there is a need for an improved rotary blade sharpener that does not suffer from these problems and limitations.

SUMMARY

Embodiments of the present invention provide a universal blade sharpener that does not suffer from the problems and limitations of the prior art sharpeners set forth above.

A first aspect of the present invention concerns a universal blade holder operable to be rotatably driven by a blade-sharpening drive having an adjustable blade sharpener. The universal blade holder is configured to securely hold any one of multiple variously sized circular blades while being sharpened by the adjustable blade sharpener, wherein each of the circular blades includes drive teeth disposed in an annular arrangement. The universal blade holder broadly includes a blade-receiving chassis operable to be rotated by the drive and rotatable about a rotation axis of the blade holder. The blade-receiving chassis includes a plurality of radially spaced blade-retaining sections each associated with a respective one of the circular blades. Each blade-retaining section includes at least a partial ring of positioning teeth projecting from the chassis and is configured to intermesh with the drive teeth of the respective one of the circular blades, thereby restricting rotational and off-axis movement of the respective one of the circular blades relative to the chassis.

A second aspect of the present invention concerns a universal blade sharpening machine operable to securely hold and sharpen any one of multiple variously sized circular blades, wherein each of the circular blades includes drive teeth disposed in an annular arrangement. The universal blade-sharpening machine broadly includes a blade-sharpening drive and a universal blade holder. The blade-sharpening drive has an adjustable blade sharpener. The universal blade holder is rotatably powered by the drive and is configured to securely hold the blade that is held during sharpening by the adjustable blade sharpener. The universal blade holder includes a blade-receiving chassis drivingly connected to the drive and rotatable about a rotation axis of the blade holder. The blade-receiving chassis includes a plurality of radially spaced blade-retaining sections each associated with a respective one of the circular blades. Each blade-retaining section includes at least a partial ring of positioning teeth projecting from the chassis and is configured to intermesh with the drive teeth of the respective one of the circular blades, thereby restricting rotational and off-axis movement of the respective one of the circular blades relative to the chassis.

A third aspect of the present invention concerns a universal blade holder operable to be rotatably driven by a blade-sharpening drive having an adjustable blade sharpener. The universal blade holder is configured to securely hold any one of multiple variously sized circular blades while being sharpened by the adjustable blade sharpener. The universal blade holder broadly includes a blade-receiving chassis and a plurality of magnets. The blade-receiving chassis is operable to be rotated by the drive and is rotatable about a rotation axis of the blade holder. The blade-receiving chassis includes a plurality of radially spaced blade-retaining sections each associated with a respective one of the circular blades. Each blade-retaining section includes a locating element that projects from the chassis and is configured to engage a complemental feature of the blade to restrict rotational movement of the blade relative to the chassis about the rotation axis. The plurality of magnets are supported on the blade-receiving chassis, with each blade-retaining section associated with a corresponding magnet that is configured to cooperate with the locating element to secure the respective one of the circular blades in driving engagement with the blade-receiving chassis.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
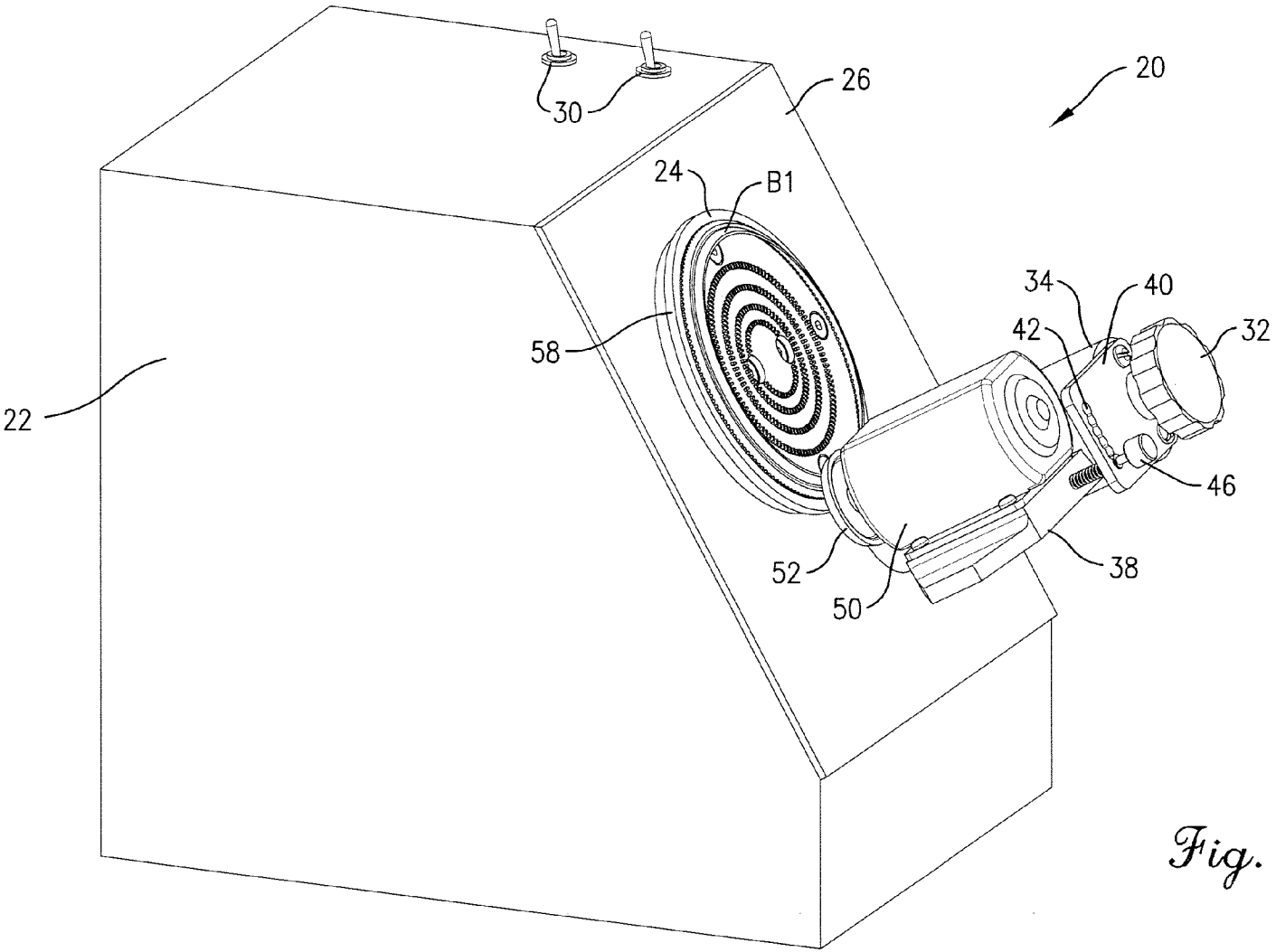
FIG. 1 is a perspective of a blade-sharpening machine constructed in accordance with a preferred embodiment of the present invention.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIG. 1-5, a blade-sharpening machine 20 is operable to sharpen endless blades B1,B2. The endless blades B1,B2 are used in a powered knife (not shown) for various steps of meat processing, such as removal of meat and fat from bones of an animal carcass and removal of fat from meat. Features of preferred powered knives are disclosed in U.S. patent application Ser. No. 11/423,266, filed Jun. 9, 2006, entitled ROTARY KNIFE WITH BLADE BUSHING, and in U.S. patent application Ser. No. 11/839,382, filed Aug. 15, 2007, entitled ROTARY KNIFE WITH BLADE BUSHING, both of which are hereby incorporated by reference herein. While the illustrated blade-sharpening machine 20 is preferably configured for sharpening the blades B1,B2, various other blade shapes can be accommodated for sharpening, as will be discussed in greater detail. The illustrated blade-sharpening machine 20 broadly includes a drive unit 22 and a universal blade holder 24.

Figure 2:
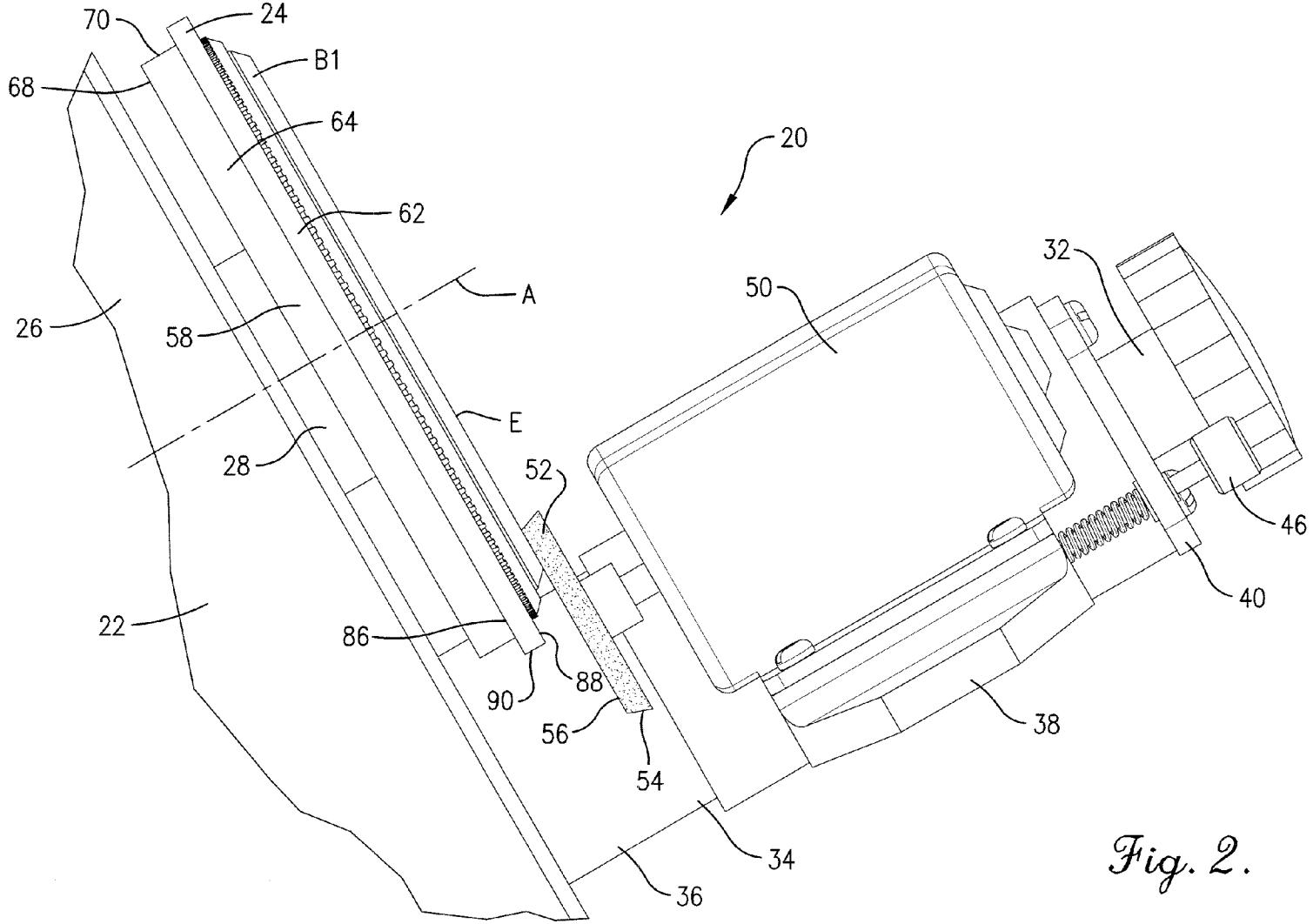
FIG. 2 is an enlarged fragmentary elevation of the blade-sharpening machine as shown in FIG. 1, showing a first annular blade mounted on a universal blade holder, with the blade holder being rotatably mounted on the blade sharpening drive, wherein a grinding wheel of the drive is pivoted into a blade-sharpening position.
Figure 3:
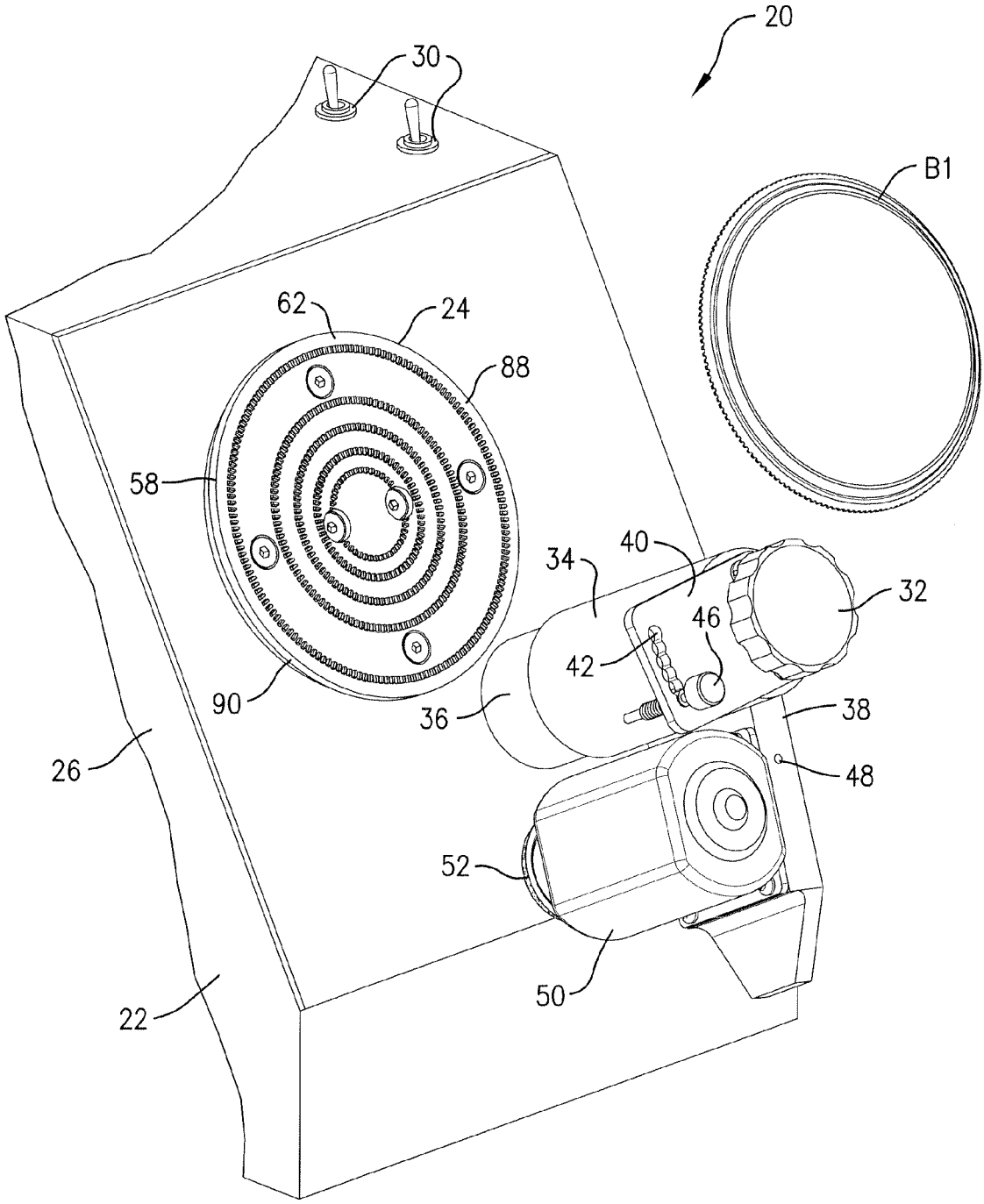
FIG. 3 is a fragmentary perspective of the blade-sharpening machine as shown in FIGS. 1 and 2, showing the first annular blade removed from the blade holder, with the grinding wheel pivoted out of the blade-sharpening position and into a blade-attachment position.
Figure 4:
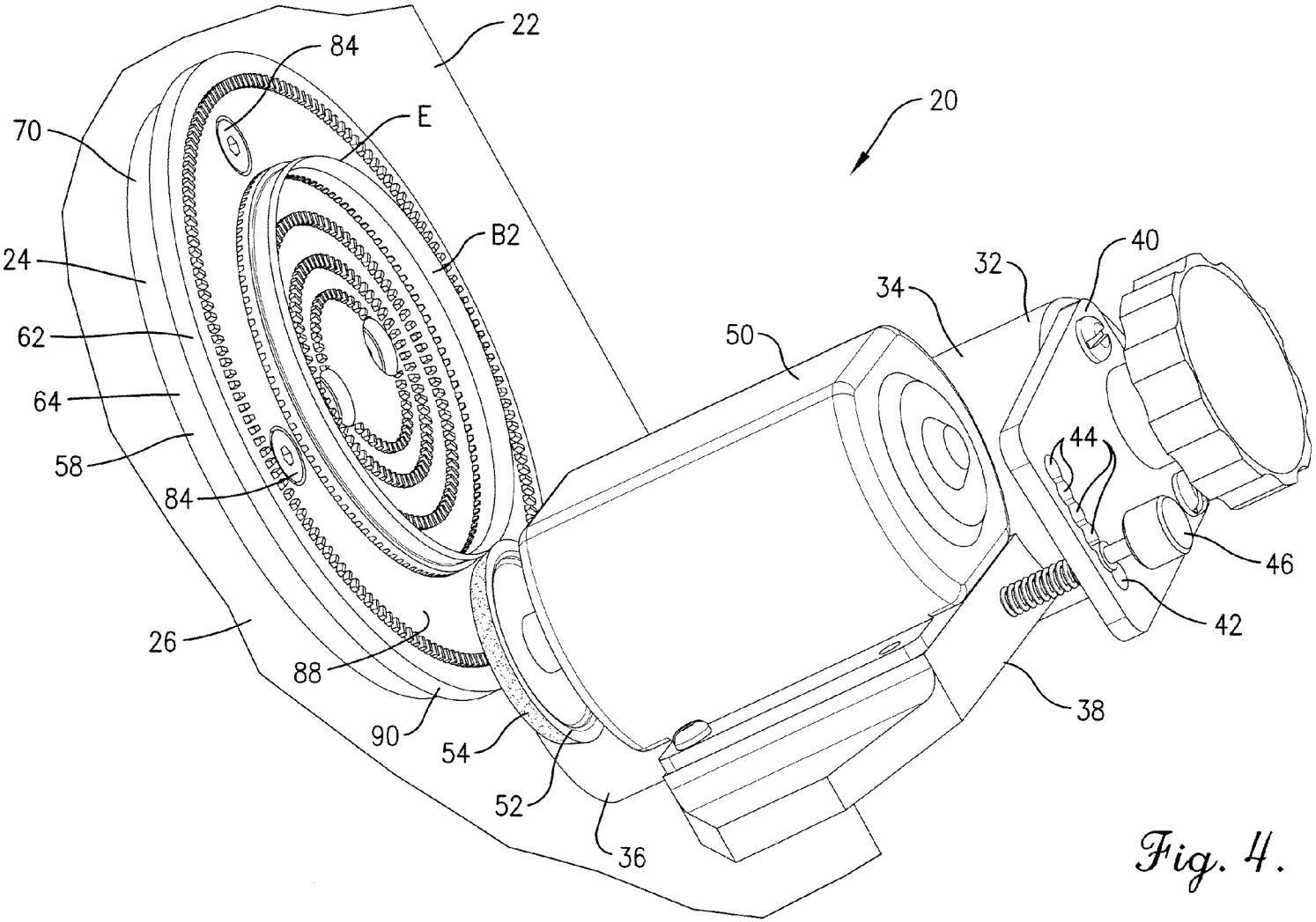
FIG. 4 is a fragmentary perspective of the blade-sharpening machine as shown in FIGS. 1-3, showing a second annular blade installed in the blade holder, with the blade holder being rotatably mounted on the blade sharpening drive and the grinding wheel pivoted into the blade-sharpening position.
Figure 5:
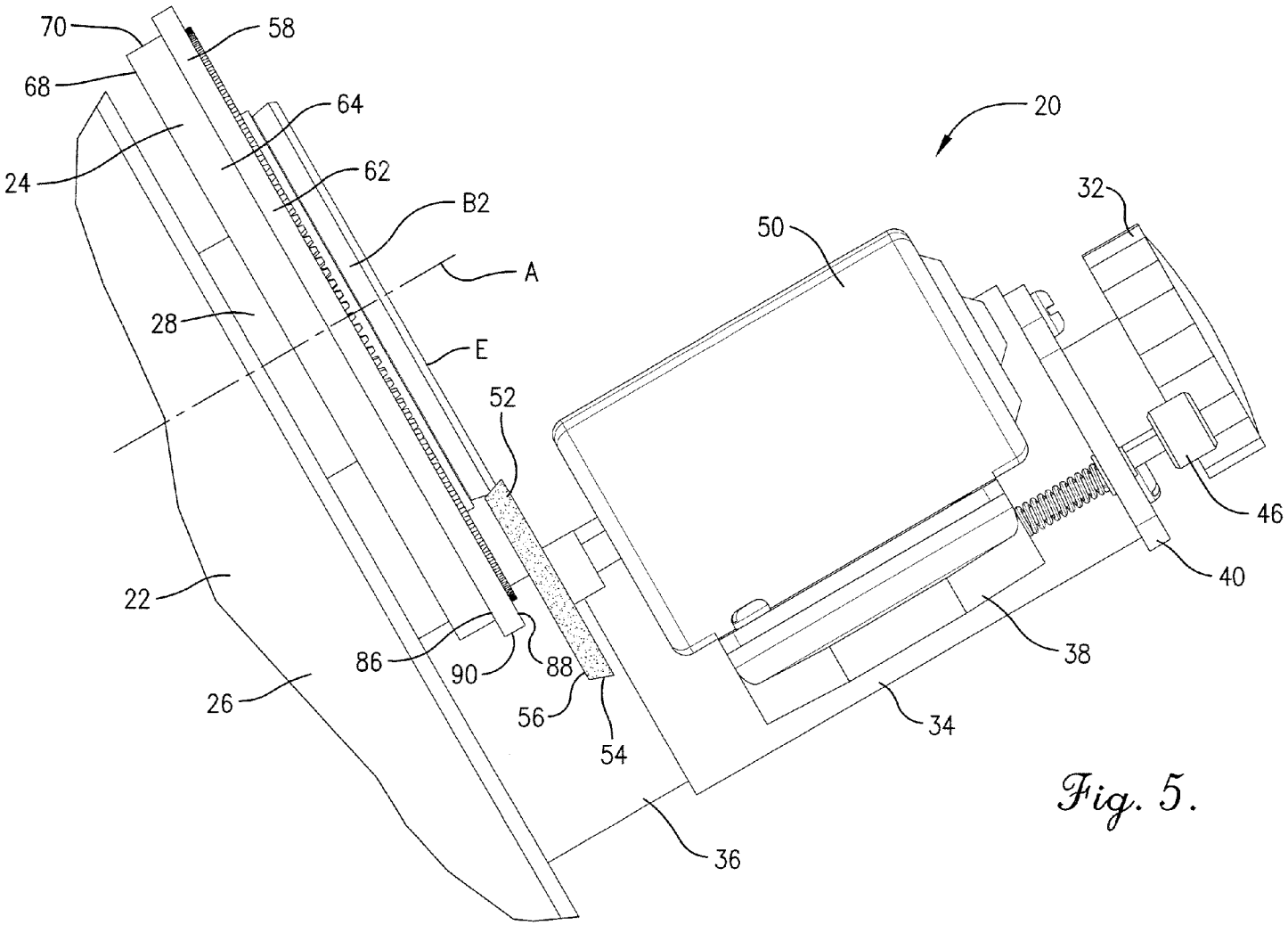
FIG. 5 is an enlarged fragmentary elevation of the blade-sharpening machine as shown in FIG. 1-4, showing the second annular blade mounted on a universal blade holder, with the grinding wheel pivoted into the blade-sharpening position.

The drive unit 22 includes, among other things, a substantially rigid base 26 and a rotatable platform 28 that supports the blade holder 24 (see FIGS. 2 and 5). As will be discussed further, the drive unit 22 is operable to rotate the blade holder 24 with a blade secured thereon to sharpen the blade. The platform 28 is rotatably driven by a platform motor (not shown) mounted within the base 26, with the motor including a rotatable drive shaft attached to the platform 28. One of the switches 30 is electrically connected to the platform motor to selectively turn the motor on and off in the usual manner.

The drive unit 22 further includes a sharpening assembly 32 mounted on the base 26 adjacent to the platform 28. The sharpening assembly 32 is operable to sharpen the blades B1,B2 and includes an adjustable stanchion 34 attached to the base 26. The stanchion 34 includes an adjustable post 36 and an arm 38 rotatably mounted on the post 36 and pivotal about an upright axis presented by the post 36. A bracket 40 is attached to an uppermost end of the post 36 and presents a distal slot 42 with a plurality of discrete slot segments 44 (see FIG. 4). The bracket 40 secures the arm 38 relative to the post 36 (i.e., restricts pivotal movement of the arm 38 about the upright post axis) by extending a pin 46 through one of the segments 44 of the slot 42 and into engagement with a hole 48 presented by an upper edge of the arm 38. The sharpening assembly 32 also includes a motor 50 mounted to one side of the arm 38 and an abrasive grinding wheel 52 drivingly attached to the drive shaft of the motor 50 and generally positioned below the motor 50. The grinding wheel 52 presents annular and endmost abrasive surfaces 54,56. The annular abrasive surface 54 extends endlessly and tapers along the axis of the drive shaft. The endmost abrasive surface 56 is arranged so that the drive shaft axis is substantially normal thereto. However, the grinding wheel 52 could present alternatively shaped abrasive surfaces without departing from the scope of the present invention.

The sharpening assembly 32 is operable to selectively position the grinding wheel 52 relative to the blade secured on the blade holder 24. Specifically, the sharpening assembly 32 is shiftable to adjust the height of the grinding wheel 52 relative to the platform 28 (measured along a rotational axis A of the blade holder 24). Also, the arm 38 pivots relative to the post 36 to shift the grinding wheel 52 about the axis of post 36 between a blade-attachment position (see FIG. 3) and a blade-sharpening position (see FIGS. 1, 2, 4, and 5). However, it is also within the ambit of the present invention where the sharpening assembly 32 is alternatively configured so that the grinding wheel 52 is otherwise shiftable relative to the base 26, e.g., where the grinding wheel 52 is slidable laterally relative to the base 26 along a straight line. Another one of the switches 30 is electrically connected to the motor 50 and is operable to turn the motor 50 on and off in the usual manner. While the illustrated drive unit 22 is preferred, it will be appreciated that the illustrated drive unit 22 could be variously configured to rotate the blade holder 24 and provide a blade-sharpening mechanism without departing from the scope of the present invention.

Turning to FIGS. 5-10, the blade holder 24 serves to selectively secure variously-sized endless blades, such as blades that are commonly used in the meat processing industry, and broadly includes a chassis 58 and a plurality of magnets 60. The chassis 58 receives blades B1,B2 and includes a blade locating plate 62 and a backing plate 64 removably stacked on top of each other. As will be discussed further, the backing plate 64 supports the locating plate 62 and is drivingly mounted to the platform 28.

Figure 6:
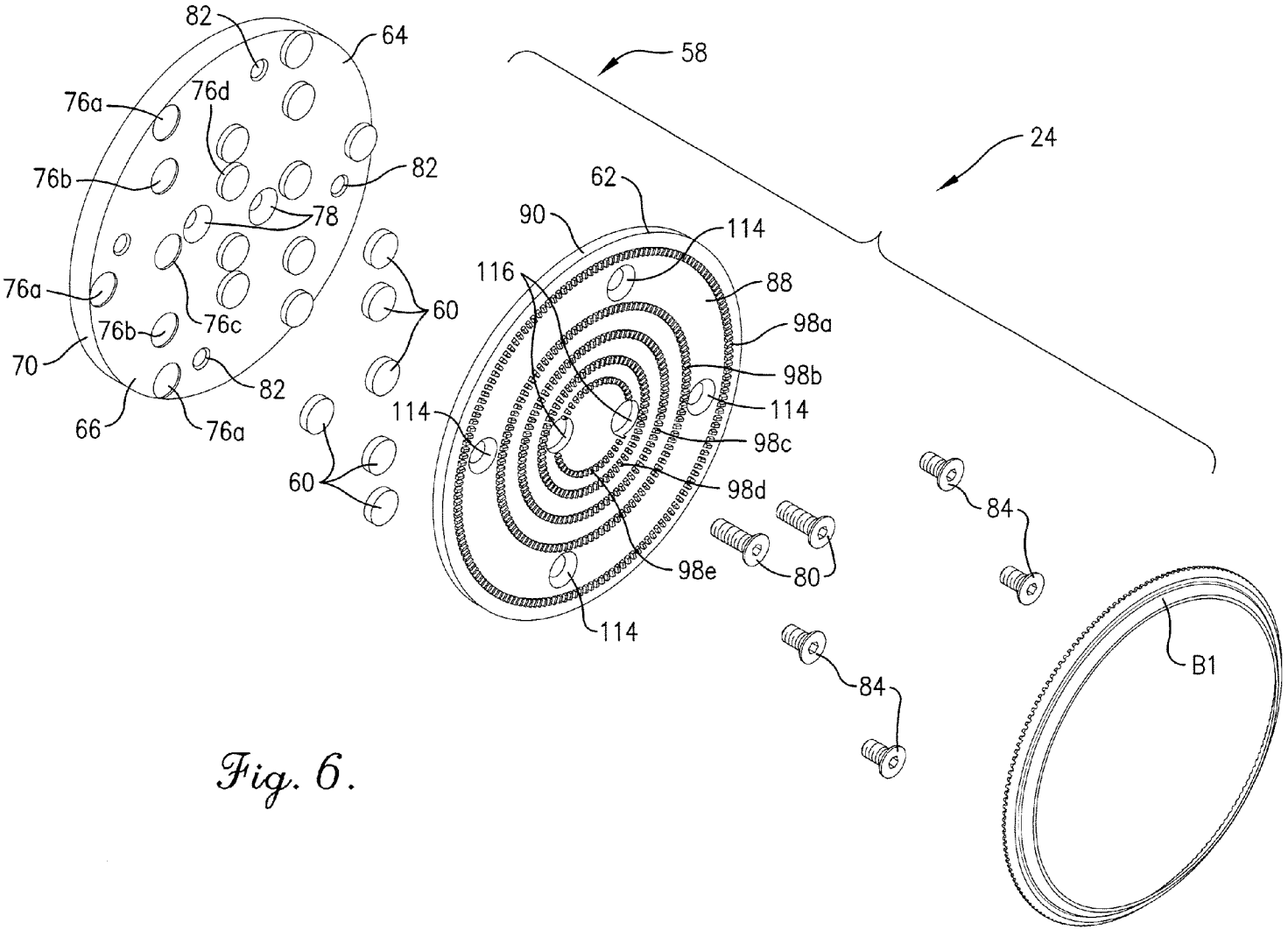
FIG. 6 is an exploded perspective of the blade holder and first annular blade as shown in FIGS. 1-3, showing a holding plate and backing plate of the blade holder detached from each other, and showing a plurality of magnets of the blade holder, with some of the magnets received by the backing plate and the remaining magnets removed from the plates.
Figure 7:
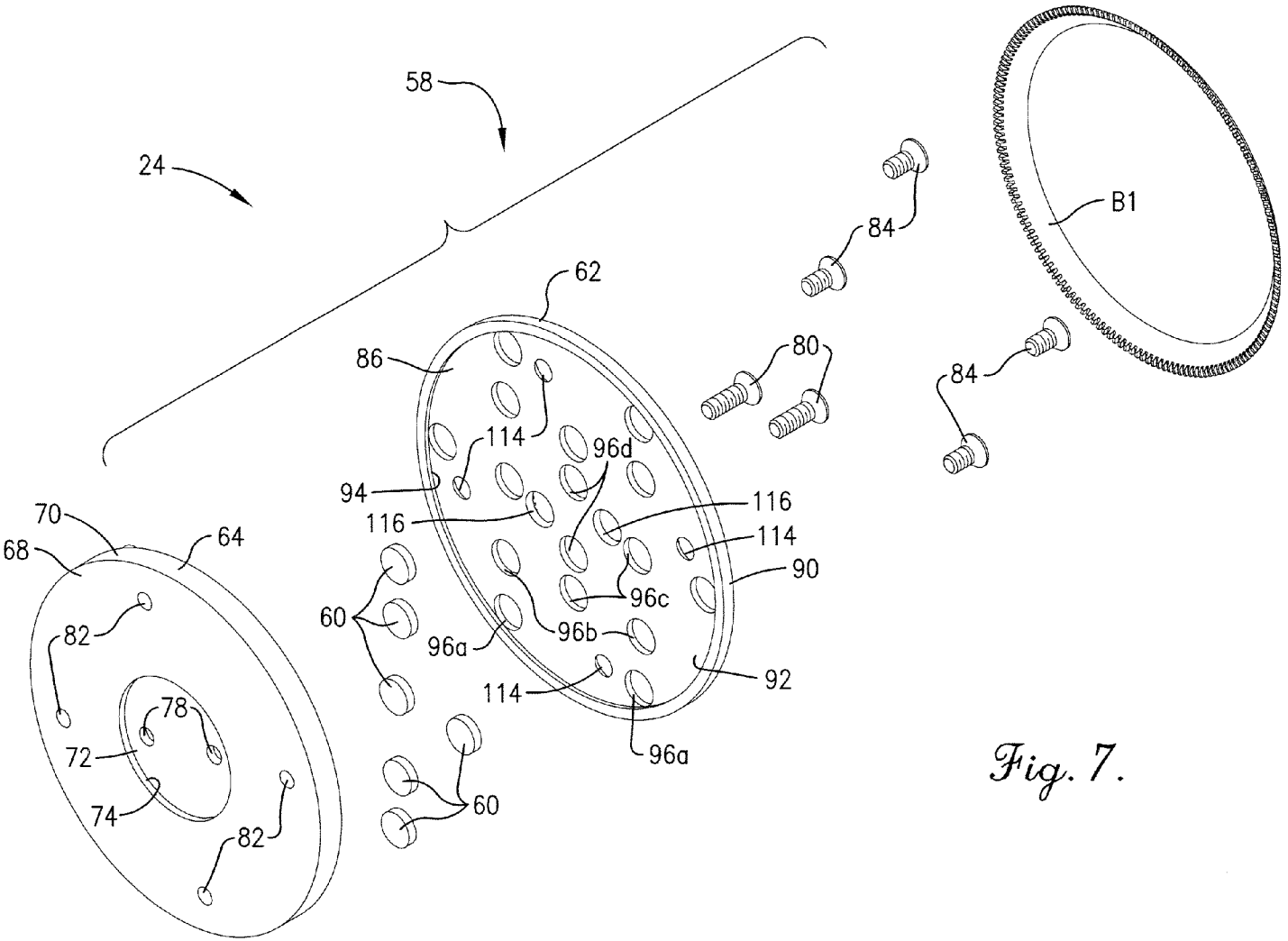
FIG. 7 is an exploded perspective of the blade holder and first annular blade as shown in FIGS. 1-3 and 6, showing the holding plate and backing plate detached from each other, and showing the plurality of magnets.
Figure 10:
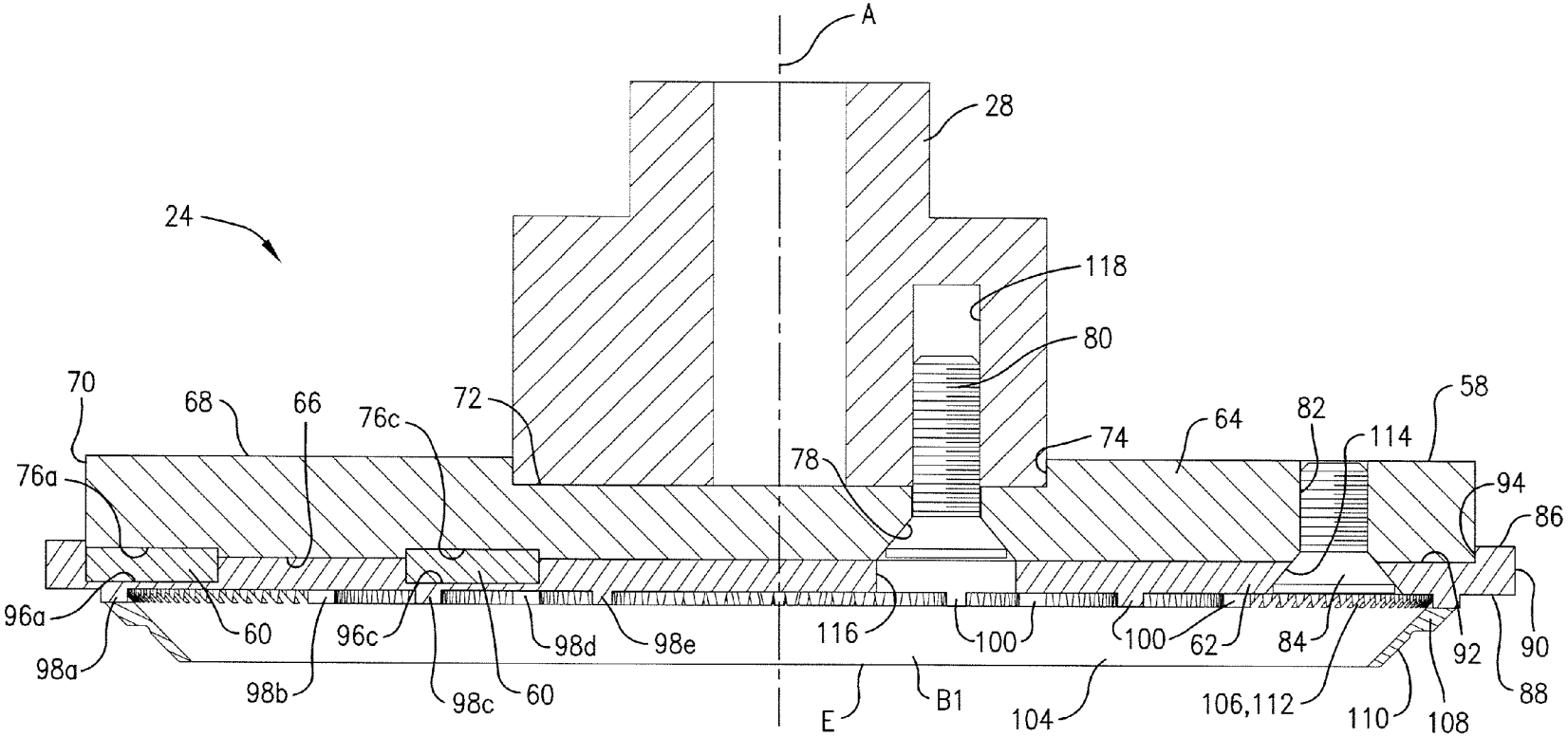
FIG. 10 is a fragmentary cross section of the blade-sharpening machine taken along line 10-10 in FIG. 9.

Turning to FIGS. 6, 7, and 10, the illustrated backing plate 64 preferably has a unitary and circular construction and presents opposite inboard and outboard faces 66,68, and an endless outer edge 70 (as used herein, the terms "inboard" and "outboard" generally refer to the location of the feature, e.g., faces 66,68, relative to the chassis 58). However, the principles of the present invention are applicable where the backing plate 64 presents an alternative shape that permits the chassis 58 to support various blades for sharpening. Furthermore, the backing plate 64 could be comprised of multiple portions attached to each other. The outboard face 68 includes a circular socket 72 defined by an annular shoulder 74 (see FIGS. 7 and 10) and configured to receive the platform 28, with the socket 72 being centered relative to the rotation axis A of the blade holder 24.

The inboard face 66 presents radially-spaced groups of seats 76*a,b,c,d* that are sized and configured to receive magnets 60. Each of the seats 76 comprises a circular socket defined by a shoulder, with the seats 76 preferably at least partly receiving a corresponding magnet 60. However, it is also within the ambit of the present invention where the seats 76 are alternatively shaped (e.g., the seats 76 could be configured to entirely receive corresponding magnets). Additionally, for some aspects of the present invention, the backing plate 64 may be devoid of seats 76, e.g., where only the locating plate 62 serves to position the magnets 60 relative to the axis A. As will be discussed in greater detail, the seats 76 are located to position the magnets 60 in predetermined locations on the chassis 58.

The backing plate 64 also includes a pair of countersunk holes 78 that receive flathead fasteners 80 for attaching the backing plate 64 to the platform 28. The backing plate 64 further includes threaded holes 82 that receive flathead fasteners 84 for attaching the plates 62,64 to each other.

The illustrated locating plate 62 is configured to receive blades B1,B2 and preferably comprises a unitary and circular construction. The locating plate 62 presents opposite inboard and outboard faces 86,88, and an endless outer edge 90. However, it is within the scope of the present invention where the locating plate 62 presents an alternative shape that permits the chassis 58 to support various blades. Similar to the backing plate 64, the locating plate 62 could also be comprised of multiple portions attached to one another.

The inboard face 86 includes a socket 92 defined by an outer shoulder 94 that extends along the outer edge 90 (see FIG. 10). The inboard face 86 also presents radially-spaced groups of seats 96*a,b,c,d*, with each seat 96 comprising a circular recess that preferably at least partly receives a corresponding magnet 60 (see FIGS. 7, 9, and 10). However, it is also within the ambit of the present invention where the seats 96 are alternatively shaped (e.g., the seats 96 could be configured to entirely receive corresponding magnets). Additionally, for some aspects of the present invention, the locating plate 62 may be devoid of seats 96, e.g., where only the backing plate 64 serves to position the magnets 60 relative to the axis A. Thus, corresponding pairs of seats 76,96 are preferably substantially aligned to cooperatively receive magnets 60 and thereby position magnets 60 in predetermined locations along the chassis 58, as will be discussed further.

Figure 9:
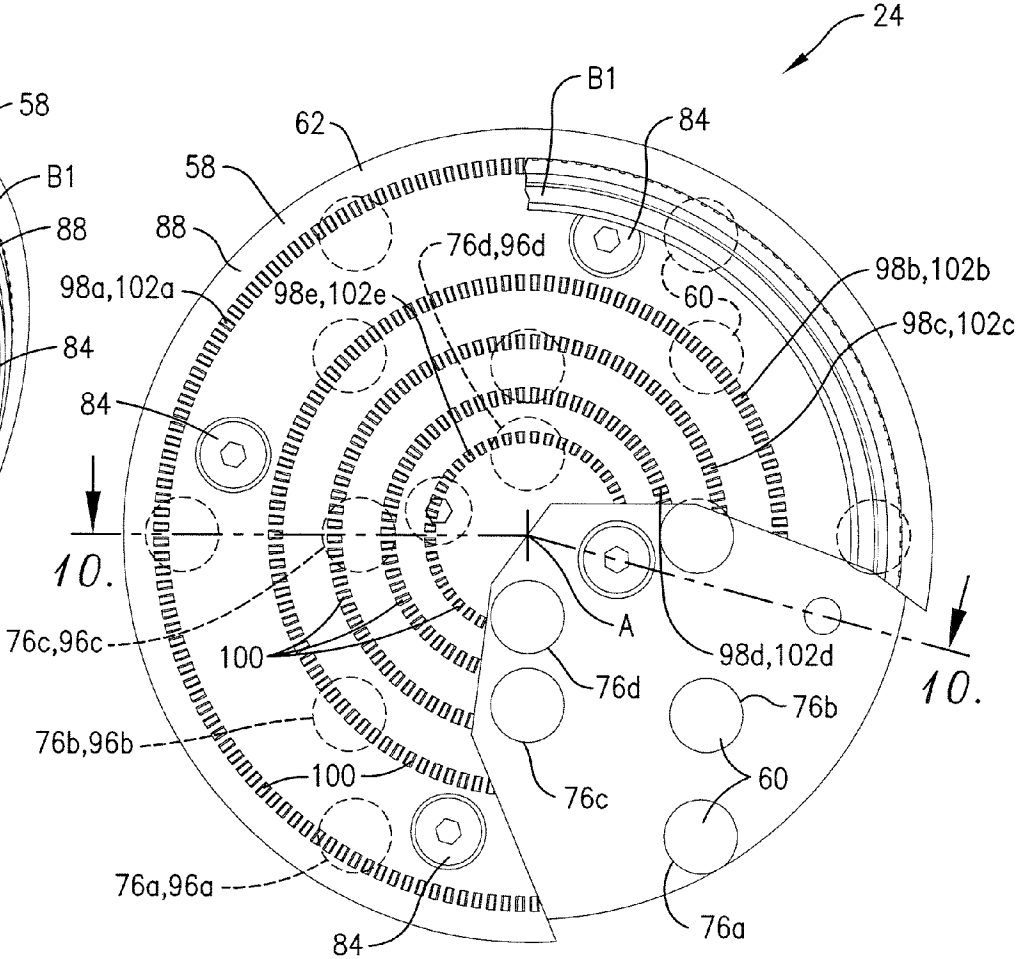
FIG. 9 is a fragmentary top view of the blade holder as shown in FIGS. 1-8, showing the first annular blade attached to the blade holder, with a portion of the first annular blade removed and a portion of the holding plate removed to show the backing plate and magnets.
Figure 8:
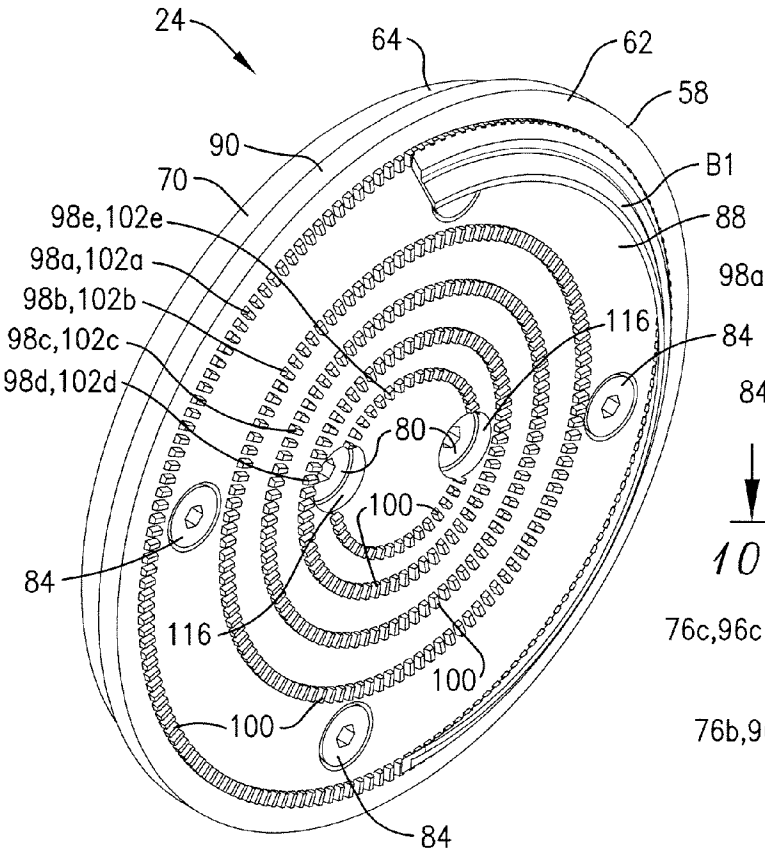
FIG. 8 is a perspective of the blade holder as shown in FIGS. 1-7, showing the first annular blade attached to the blade holder, with a portion of the first annular blade removed.

Turning to FIGS. 8-10, the locating plate 62 preferably includes a plurality of substantially concentric blade locating sections 98*a,b,c,d,e* that are integral to the body of the locating plate 62. Each locating section 98*a-e* preferably includes a plurality of gear teeth 100 that are configured to intermesh with complemental teeth of corresponding endless blades and restrict relative rotational movement between the endless blade and blade holder 24. Concerning sections 98*a-d*, the teeth 100 are arranged to form an endless ring of teeth, while the teeth 100 of section 98*e* form two arcuate ring segments. However, it is also within the scope of the present invention where the gear teeth 100 form one or more partial rings of teeth in any of sections 98*a-d*, where teeth 100 form an endless ring of teeth in section 98*e*, or where the teeth 100 are otherwise configured and positioned about the rotation axis A for securing arcuate blades.

The endless rings of teeth are preferably substantially centered about the rotation axis A of the blade holder 24. Furthermore, the teeth 100 of each section 98*a-e* present a corresponding arcuate locating surface 102*a-e* that centers the endless blades relative to the rotation axis A. In this manner, the blade holder 24 promotes uniform sharpening of the endless blades. Locating surfaces 102*a-d* are preferably endless, but it is also within the scope of the present invention where the locating surfaces 102*a-d* are not endless (such as locating surface 102*e*, which is interrupted by a pair of bores). Furthermore, the locating surfaces 102 could each include a feature other than teeth 100 for centering the endless blades, e.g., a circumferentially-extending shoulder that engages an inner or outer edge of teeth 100. The locating plate 62 preferably includes five sections 98*a-e* that are sized to correspond to standard blade sizes with blade diameters ranging from about one and one-quarter (1.25) inches to about five (5) inches, but more or fewer sections 98 could be included on the locating plate 62 without departing from the scope of the present invention. More preferably, the locating sections 98 present the following outermost diameter dimensions:

| Blade Locating Section | Outermost Dia |
|---|---|
| 98a | 5.025 inches |
| 98b | 3.530 |
| 98c | 2.725 |
| 98d | 2.028 |
| 98e | 1.440 |

In the illustrated embodiment, the locating plate 62 is depicted as receiving blades B1,B2. Blade B1 includes a blade wall 104 and ring gear 106, with the blade wall 104 including a support section 108 and cutting section 110. The support section 108 interconnects the ring gear 106 and cutting section 110 (see FIG. 10). The ring gear 106 includes a plurality of teeth 112 spaced about the circumference of the blade B1. In use, blade B1 is driven by a powered knife, such as one of the powered knives disclosed in the above-incorporated applications. The powered knife includes a drive gear with teeth that drivingly engage complemental teeth 112 of the blade B1 and thereby spin the blade B1 within the powered knife.

While the illustrated blade-sharpening machine 20 is preferably configured for sharpening the blade B1, various other blade shapes can be accommodated, such as alternative endless blade B2 (see FIGS. 4 and 5), which presents an alternative blade profile. Other types of blades, e.g., an annular blade that presents a pair of ends or a blade including a plurality of discrete blade sections, could be sharpened by the illustrated machine 20 without departing from the scope of the present invention. Blades B1,B2 also preferably include or are entirely formed of a stainless steel material and, more preferably, include or are entirely formed of a magnetic stainless steel that is magnetically attracted to magnets 60. Features of other preferred endless blades are disclosed in the above-incorporated applications.

Turning to FIG. 9, respective groups of seats 96*a,b,c,d* are preferably spaced radially from the axis A at the same radial distance. That is, seats 96*a* are all spaced from axis A at a first radial distance, seats 96*b* are all spaced from axis A at a second radial distance, seats 96*c* are spaced from axis A at a third radial distance, and seats 96*d* are spaced from axis A at a fourth radial distance. More preferably, the seats 96*a-d* are radially positioned to locate magnets 60 adjacent to respective locating sections 98. Most preferably, seats 96*a* radially overlap section 98*a*, seats 96*b* radially overlap section 98*b*, seats 96*c* radially overlap sections 98*c,d*, and seats 96*d* radially overlap section 98*e*. It is also within the ambit of the present invention where the groups of seats 96 are alternatively radially configured or positioned to locate the magnets 60 relative to the sections 98. For example, each radial group of seats 96 could be configured to radially overlap a single respective section 98.

In addition, the seats 96 in each group are preferably spaced uniformly from each other in a circumferential direction. More preferably, six (6) seats 96*a* are spaced at an angle of sixty (60) degrees from adjacent seats 96*a*, four (4) seats 96*b* are spaced at an angle of ninety (90) degrees from adjacent seats 96*b*, four (4) seats 96*c* are spaced at an angle of ninety (90) degrees from adjacent seats 96*c*, and two (2) seats 96*d* are spaced at an angle of one hundred eighty (180) degrees from adjacent seats 96*d*. However, the seats 96 could have an alternative circumferential spacing without departing from the scope of the present invention.

Preferably, seats 76 are positioned on plate 64 so as to be aligned with corresponding seats 96 when the plates 62,64 are attached to one another (see FIG. 9). Thus, each of the aligned pairs of seats 76,96 cooperatively present an enclosed cavity that receives a respective magnet 60 (see FIG. 10). But it is also within the scope of the present invention where only one of the plates 62,64 are configured to receive and thereby position the magnets 60 along the chassis 58.

The magnets 60 each preferably include a rare earth permanent magnet material. More preferably, the magnets 60 include a neodymium alloy material. However, it is also within the ambit of the present invention where the magnets 60 include other materials. Furthermore, the magnets 60 could comprise an electromagnet without departing from the scope of the present invention. The magnets 60 also preferably present a cylindrical form with a diameter between about one-quarter (0.25) inch and about one (1) inch and a thickness between about one-eighth (0.125) inch and about one-half (0.5) inch. This arrangement keeps the vertical profile of the chassis small, while providing a secure means for releasably holding each blade on the corresponding locating section 98. However, the magnets 60 could present an alternative size and/or shape without departing from the scope of the present invention.

Turning again to FIGS. 6-10, the magnets 60 are received within corresponding seats 76,96 and are held between the plates 62,64. The magnets 60 are secured to the seats 76,96 with a layer of adhesive (not shown) that is applied to one of the seats 76,96 and to the magnet 60. The plates 62,64 are rotated so that corresponding seats 76,96 are aligned with each other (see FIG. 9). The plates 62,64 are then secured to each other by aligning countersunk holes 114 with respective threaded holes 82 and by inserting fasteners 84 through the holes 114 and into holes 82 (see FIGS. 6 and 10). The assembled blade holder 24 is secured to platform 28 by inserting fasteners 80 through bores 116 in locating plate 62, through holes 78 in backing plate 64, and into threaded holes 118 in the platform 28 (see FIG. 10).

Annular blades B1,B2 are selectively secured to the blade holder 24 by intermeshing the gear teeth of the blade with teeth 100 of the corresponding locating section 98. As discussed previously, the locating section 98 intermeshes with the teeth of the blade to restrict relative rotational movement between the blade and blade holder 24. Furthermore, the locating section 98 restricts off-axis lateral movement of the blade relative to the blade holder 24 (i.e., the locating section 98 centers the blade on the blade holder 24). Yet further, the blades B1,B2 preferably include a ferrous material that is attracted to the magnets 60, and the magnets 60 thereby hold the blade against the locating plate 62 by applying a magnetic force to the blade. Thus, the magnets 60 restrict blade movement along the rotation axis A. The magnets consequently serve as a securing system for releasably securing each blade against the chassis 58. However, according to certain aspects of the present invention, the blade holder may be provided with an alternative securing system or no securing system at all. For example, the holder could alternatively (or in addition to the magnets 60) be provided with an adhesive (such as a removable hot glue) for holding the blade against the respective locating section.

In operation, the motor 50 and grinding wheel 52 of the sharpening assembly 32 are pivoted out of the blade-sharpening position and into the blade-attachment position to permit installation of the blade B1, blade B2, or another annular blade onto the machine 20. The blade B1 is secured in the blade holder 24 by positioning teeth 112 of the blade B1 into intermeshing engagement with teeth 100 of locating section 98*a* (see FIG. 10). As the blade B1 approaches engagement with the locating section 98*a*, magnets 60 apply a magnetic force to the blade B1 that holds the blade into driving engagement with the chassis 58, with the blade B1 being centered relative to rotation axis A. The sharpening assembly 32 is returned to the blade-sharpening position so that the grinding wheel 52 contacts the blade edge E (see FIG. 2). Again, the blade holder 24 can be rotated while the motor 50 is simultaneously rotating to sharpen the entire blade edge E.

The blade B1 is removed from the machine 20 by initially pivoting the sharpening assembly 32 out of the blade-sharpening position. The blade B1 is removable from the blade holder 24 by pulling the blade B1 away from the chassis 58, i.e., by overcoming the magnetic force applied to the blade B1 by the magnets 60.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A universal blade holder operable to be rotatably driven by a blade-sharpening drive having an adjustable blade sharpener, said universal blade holder configured to securely hold any one of multiple variously sized circular blades while being sharpened by the adjustable blade sharpener, wherein each of the circular blades includes drive teeth disposed in an annular arrangement, said universal blade holder comprising:

a blade-receiving chassis operable to be rotated by the drive and rotatable about a rotation axis of the blade holder, said blade-receiving chassis including a plurality of radially spaced blade-retaining sections each associated with a respective one of the circular blades, each blade-retaining section including at least a partial ring of positioning teeth projecting from the chassis and being configured to intermesh with the drive teeth of the respective one of the circular blades, thereby restricting rotational and off-axis movement of the respective one of the circular blades relative to the chassis.

2. The universal blade holder as claimed in claim 1; and a securing system operable to releasably hold each of the circular blades against the chassis.

3. The universal blade holder as claimed in claim 2, said securing system including a plurality of magnets supported on the blade-receiving chassis, with each blade-retaining section associated with a corresponding magnet that is configured to cooperate with a respective ring of positioning teeth to secure the respective one of the circular blades in driving engagement with the blade-receiving chassis.

4. The universal blade holder as claimed in claim 3, each blade-retaining section associated with multiple corresponding magnets, with the corresponding magnets being spaced apart and positioned adjacent the respective ring of positioning teeth.

5. The universal blade holder as claimed in claim 4, at least one of said rings of positioning teeth being endless, with the corresponding magnets spaced uniformly along the circumferential length of the at least one ring of positioning teeth.

6. The universal blade holder as claimed in claim 3, said blade-receiving chassis including a locating plate presenting opposite inner and outer faces, said blade-retaining sections extending along the outer face and said magnets being positioned along the inner face.

7. The universal blade holder as claimed in claim 6, said inner face presenting a plurality of recessed magnet seats each configured to receive a respective one of the magnets.

8. The universal blade holder as claimed in claim 7, said blade-receiving chassis including a backing plate removably attached to the locating plate, said backing plate engaging the inner face and cooperating with the locating plate to secure the magnets within the chassis.

9. The universal blade holder as claimed in claim 3, said magnets comprising permanent magnets.

10. The universal blade holder as claimed in claim 9, said magnets including a neodymium alloy.

11. The universal blade holder as claimed in claim 1, at least one of said rings of positioning teeth being endless such that the positioning teeth are configured to engage the respective one of the blades about the entire circumference thereof.

12. A universal blade sharpening machine operable to securely hold and sharpen any one of multiple variously sized circular blades, wherein each of the circular blades includes drive teeth disposed in an annular arrangement, said universal blade-sharpening machine comprising:

a blade-sharpening drive having an adjustable blade sharpener; and a universal blade holder rotatably powered by the drive and configured to securely hold the blade that is held during sharpening by the adjustable blade sharpener, said universal blade holder including a blade-receiving chassis drivingly connected to the drive and rotatable about a rotation axis of the blade holder, said blade-receiving chassis including a plurality of radially spaced blade-retaining sections each associated with a respective one of the circular blades, each blade-retaining section including at least a partial ring of positioning teeth projecting from the chassis and being configured to intermesh with the drive teeth of the respective one of the circular blades, thereby restricting rotational and off-axis movement of the respective one of the circular blades relative to the chassis.

13. The universal blade sharpening machine as claimed in claim 12, said universal blade holder including a securing system operable to releasably hold each of the circular blades against the chassis.

14. The universal blade sharpening machine as claimed in claim 13, said securing system including a plurality of magnets supported on the blade-receiving chassis, with each blade-retaining section associated with a corresponding magnet that is configured to cooperate with a respective ring of positioning teeth to secure the respective one of the circular blades in driving engagement with the blade-receiving chassis.

15. The universal blade sharpening machine as claimed in claim 14, each blade-retaining section associated with multiple corresponding magnets, with the corresponding magnets being spaced apart and positioned adjacent the respective ring of positioning teeth.

16. The universal blade sharpening machine as claimed in claim 15, at least one of said rings of positioning teeth being endless, with the corresponding magnets spaced uniformly along the circumferential length of the ring of positioning teeth.

17. The universal blade sharpening machine as claimed in claim 14, said blade-receiving chassis including a locating plate presenting opposite inner and outer faces, said blade-retaining sections extending along the outer face and said magnets being positioned along the inner face.

18. The universal blade sharpening machine as claimed in claim 17, said inner face presenting a plurality of recessed magnet seats each configured to receive a respective one of the magnets.

19. The universal blade sharpening machine as claimed in claim 18, said blade-receiving chassis including a backing plate removably attached to the locating plate, said backing plate engaging the inner face and cooperating with the locating plate to secure the magnets within the chassis.

20. The universal blade sharpening machine as claimed in claim 14, said magnets comprising permanent magnets.

21. The universal blade sharpening machine as claimed in claim 20, said magnets including a neodymium alloy.

22. The universal blade sharpening machine as claimed in claim 12, at least one of said rings of positioning teeth being endless such that the positioning teeth are configured to engage the respective one of the blades about the entire circumference thereof.

23. A universal blade holder operable to be rotatably driven by a blade-sharpening drive having an adjustable blade sharpener, said universal blade holder configured to securely hold any one of multiple variously sized circular blades while being sharpened by the adjustable blade sharpener, said universal blade holder comprising:

a blade-receiving chassis operable to be rotated by the drive and rotatable about a rotation axis of the blade holder, said blade-receiving chassis including a plurality of radially spaced blade-retaining sections each associated with a respective one of the circular blades, each blade-retaining section including a locating element that projects from the chassis and is configured to engage a complemental feature of the blade to restrict rotational movement of the blade relative to the chassis about the rotation axis; and a plurality of magnets supported on the blade-receiving chassis, with each blade-retaining section associated with a corresponding magnet that is configured to cooperate with a respective locating element to secure the respective one of the circular blades in driving engagement with the blade-receiving chassis.

24. The universal blade holder as claimed in claim 23, each blade-retaining section presenting a circumferentially-extending blade-centering surface that restricts off-axis movement of the blade relative to the chassis.

25. The universal blade holder as claimed in claim 24, each blade-retaining section associated with multiple corresponding magnets, with the corresponding magnets being spaced apart and positioned adjacent the blade-centering surface.

26. The universal blade holder as claimed in claim 25, said blade-centering surface extending endlessly about the rotation axis, with the respective corresponding magnets spaced uniformly along the circumferential length of the blade-centering surface.

27. The universal blade holder as claimed in claim 24, said blade-receiving chassis including a locating plate presenting opposite inner and outer faces, said blade-retaining sections extending along the outer face and said magnets being positioned along the inner face.

28. The universal blade holder as claimed in claim 27, said inner face presenting a plurality of recessed magnet seats each configured to receive a respective one of the magnets.

29. The universal blade holder as claimed in claim 28, said blade-receiving chassis including a backing plate removably attached to the locating plate, said backing plate engaging the inner face and cooperating with the locating plate to secure the magnets within the chassis.

30. The universal blade holder as claimed in claim 24, at least one of said locating elements comprising a plurality of circumferentially-spaced gear teeth presenting at least part of the blade-centering surface and configured to engage complemental teeth of the respective blade, with the annular gear teeth serving to restrict rotational and off-axis movement of the blade relative to the chassis.

31. The universal blade holder as claimed in claim 30, said plurality of circumferentially-spaced gear teeth being arranged to define an endless ring of teeth.

32. The universal blade holder as claimed in claim 23, said magnets comprising permanent magnets.

33. The universal blade holder as claimed in claim 32, said magnets including a neodymium alloy.

* * * * *